US008978625B2

(12) United States Patent
Okuda et al.

(10) Patent No.: US 8,978,625 B2
(45) Date of Patent: Mar. 17, 2015

(54) INTERNAL COMBUSTION ENGINE CONTROLLER

(75) Inventors: Mamoru Okuda, Hitachinaka (JP); Takuya Mayuzumi, Hitachinaka (JP); Fumiaki Nasu, Hitachinaka (JP); Chikara Oomori, Hirakata (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 930 days.

(21) Appl. No.: 13/117,554

(22) Filed: May 27, 2011

(65) Prior Publication Data

US 2011/0295492 A1 Dec. 1, 2011

(30) Foreign Application Priority Data

May 31, 2010 (JP) ..... 2010-123900

(51) Int. Cl.
*F02M 51/00* (2006.01)
*F02D 41/20* (2006.01)

(52) U.S. Cl.
CPC ..... *F02D 41/20* (2013.01); *F02D 2041/2003* (2013.01); *F02D 2041/2051* (2013.01); *F02D 2041/2058* (2013.01)
USPC ..... 123/490

(58) Field of Classification Search
CPC ..... F02D 2041/2003; F02D 41/20; F02D 2041/201; F02D 2041/2006; F02D 2041/2013; F02D 2041/2051
USPC ..... 123/456, 478, 490, 472, 480; 701/102, 701/103, 104; 239/585.1, 585.2; 251/129.15; 361/151, 152, 153, 154
See application file for complete search history.

(56) References Cited

U.S. PATENT DOCUMENTS 5,995,356 A * 11/1999 Glavmo et al. ..... 361/154
2002/0189593 A1* 12/2002 Yamakado et al. ..... 123/490

(Continued)

FOREIGN PATENT DOCUMENTS

EP 1 717 824 A2 11/2006
EP 2 105 599 A2 9/2009

(Continued)

OTHER PUBLICATIONS

European Search Report dated Sep. 28, 2011 (three (3) pages).

*Primary Examiner* — Mahmoud Gimie
*Assistant Examiner* — Sizo Vilakazi
(74) *Attorney, Agent, or Firm* — Crowell & Moring LLP

(57) ABSTRACT

At the time of drop of an injector current of an internal combustion engine controller, the drop is performed quickly while heat generation of a drive circuit is suppressed, and valve closing response speed of the injector is enhanced. The internal combustion engine controller includes a drive circuit which drives an injector current, and a boost circuit which boosts a battery voltage, and includes a peak current path for guiding a boost voltage of the boost circuit to an upstream side of the injector via a boost side switching element and a boost side protection diode, a holding current path for guiding the battery voltage to the upstream side of the injector via a battery side switching element and a battery side protection diode, a ground current path which is connected to a power supply ground from a downstream side of the injector via a downstream side switching element, and a regenerating circuit which allows the boost circuit to regenerate electric energy of the injector from the downstream side of the injector via a current regenerating diode, wherein the regenerating path is provided with a voltage regulating section in series with the current regenerating diode, and the drive circuit controls drive of the switching element.

10 Claims, 7 Drawing Sheets

(56) References Cited

U.S. PATENT DOCUMENTS

| | | | | |
|---|---|---|---|---|
| 2003/0062029 | A1* | 4/2003 | Oyama et al. | 123/490 |
| 2005/0047053 | A1 | 3/2005 | Meyer et al. | |
| 2006/0238949 | A1* | 10/2006 | Cheever | 361/139 |
| 2008/0030917 | A1* | 2/2008 | Takahashi et al. | 361/152 |
| 2008/0289607 | A1* | 11/2008 | Mayuzumi et al. | 123/490 |
| 2009/0183714 | A1* | 7/2009 | Mayuzumi | 123/490 |
| 2009/0243574 | A1* | 10/2009 | Mayuzumi et al. | 323/282 |
| 2011/0220069 | A1* | 9/2011 | Hatanaka et al. | 123/490 |
| 2011/0295492 | A1* | 12/2011 | Okuda et al. | 701/103 |

FOREIGN PATENT DOCUMENTS

| | | | |
|---|---|---|---|
| JP | 2003-106200 | A | 4/2003 |
| JP | 2008-41908 | A | 2/2008 |
| WO | WO 97/04230 | A1 | 2/1997 |
| WO | WO 2005/014992 | A1 | 2/2005 |

* cited by examiner

INTERNAL COMBUSTION ENGINE CONTROLLER

BACKGROUND OF THE INVENTION

1. Field of the Invention

The present invention relates to an internal combustion engine controller for driving a load by using a high voltage obtained by boosting a battery voltage, in an automobile, a motorcycle, a farm machine, a machine tool, a marine engine and the like which use gasoline, light oil and the like as a fuel, and particularly relates to an internal combustion engine controller preferable in driving a cylinder injection direct injector.

2. Background Art

Conventionally in the internal combustion engine controllers of an automobile, a motorcycle, a farm machine, a machine tool, a marine engine and the like which use gasoline, light oil and the like as fuels, those including injectors which directly inject a fuel into cylinders have been used for the purpose of enhancement of fuel efficiency and output power, and such an injector is called "a cylinder injection direct injector" or "direct injector" or simply called "DI". As compared with the method which makes a gaseous mixture of air and a fuel and injects the mixture into a cylinder, and is a main stream of the present gasoline engines, the engine using a cylinder injection direct injector requires high energy for a valve opening operation of the injector, since the engine uses the fuel which is pressurized at a high pressure. Further, in order to enhance controllability in high-speed revolution, the high energy needs to be supplied to the injector in a short time.

Many of the conventional internal combustion engine controllers which control the cylinder injection direct injectors adopt the method which provides a boost circuit which boosts a voltage to a voltage higher than the battery voltage, and increases the current which is passed to the injectors in a short time by using the generated boost voltage. The peak current of a typical direct injector is about 5 times to 20 times as large as the injector current of the method which prepares a gaseous mixture of a fuel and air and injects the mixture into the cylinder, and is a main stream of the present gasoline engines.

Quick valve closure of an injector after injecting a fuel into a cylinder is effective in reducing difference in response time due to variations among the injectors of the respective cylinders, and by extension, reduction of the variations in the fuel injection amount among the cylinders, in making the control of the fuel injection amount more accurate, and in reducing useless injection of the fuel to improve fuel efficiency since the valve closing response speed becomes high, and therefore, it is necessary to shorten the drop time of the injector current and cut of the current quickly.

However, in an injector, high energy is accumulated since the injector current flows therein, and in order to cut off the current, the energy needs to be eliminated from the injector. In order to realize this within a short time, various methods are adopted, such as the method which converts energy into thermal energy by using the Zener diode effect of the downstream side switch element (FET) of the drive circuit which drives an injector current, and the method which causes the boost capacitor of the boost circuit to regenerates the injector current through a current regenerating diode. In any method, in order to speed up drop of the injector current, the energy elimination amount per hour from the injector needs to be increased.

In the former method, energy elimination is performed by converting the energization energy of the injector into thermal energy with the downstream side switch element (the third switch element for sink) by using the Zener diode effect as described in JP Patent Application Publication No. 2003-106200 A. In order to increase the energy elimination amount per hour from the injector, it is necessary to select the components with a high Zener diode voltage, but if the Zener diode voltage becomes high, the thermal energy which is generated in the downstream side switch element becomes large, and therefore, the method is not suitable for the drive circuit which uses a large current.

In contrast with this, in the latter method, the electric energy of the injector is regenerated by the boost circuit through the current regenerating diode which is connected to the boost circuit from the downstream side of the injector, and therefore, even if a large current is passed to the injector, heat generation of the drive circuit can be suppressed to be relatively low. However, since the voltage of the regeneration destination is fixed to the boost voltage (100A), the elimination amount per hour of the electric energy of the injector and the drop time of the injector current substantially depend on the boost voltage, and are limited.

From above, in order to cause the boost circuit to regenerate the electric energy of the injector, and drop the injector current quickly while generation of the thermal energy of the drive circuit is suppressed as much as possible, enhancement of the voltage of the regeneration destination of the injector current is desired.

SUMMARY OF THE INVENTION

An object of the present invention is to provide an internal combustion engine controller including a drive circuit which makes drop of an injector current within a short time while inhibiting electric energy at the time of drop of the injector current from being converted into thermal energy of the drive circuit, and causing the boost circuit to regenerate the remaining electric energy, and can increase a valve closing response speed of the injector.

In order to solve the above described problem, a controller of an internal combustion engine according to the present invention is a controller of an internal combustion engine including a drive circuit which drives an injector current for controlling an injector which injects a fuel, and a boost circuit which boosts a battery voltage, and includes a peak current path for driving a peak current by guiding a boost voltage of the boost circuit to an upstream side of the injector via a boost side switching element and a boost side protection diode, a holding current path for driving a holding current by guiding the battery voltage to the upstream side of the injector via a battery side switching element and a battery side protection diode, a ground current path which is connected to a power supply ground from a downstream side of the injector via a downstream side switching element, and a regenerating circuit which allows the boost circuit to regenerate electric energy of the injector from the downstream side of the injector via a current regenerating diode, wherein the regenerating path is provided with a voltage regulating section in series with the current regenerating diode, and the drive circuit controls drive of the switching element.

According to the present invention, there are provided remarkable operational effects that heat generation of the drive circuit by electric energy generated by the injector is suppressed while the function of generating a high voltage necessary for driving the cylinder injection direct injector of an internal combustion engine is ensured, and the injector current is quickly dropped by causing the boost capacitor of the boost circuit to regenerate the electric energy, whereby variation of the fuel injection amount is reduced, highly accurate control is enabled, useless fuel injection is reduced, and fuel efficiency is enhanced.

DETAILED DESCRIPTION OF THE PREFERRED EMBODIMENTS

Hereinafter, embodiments of the present invention will be described with use of the drawings.

Embodiment 1

Figure 1:
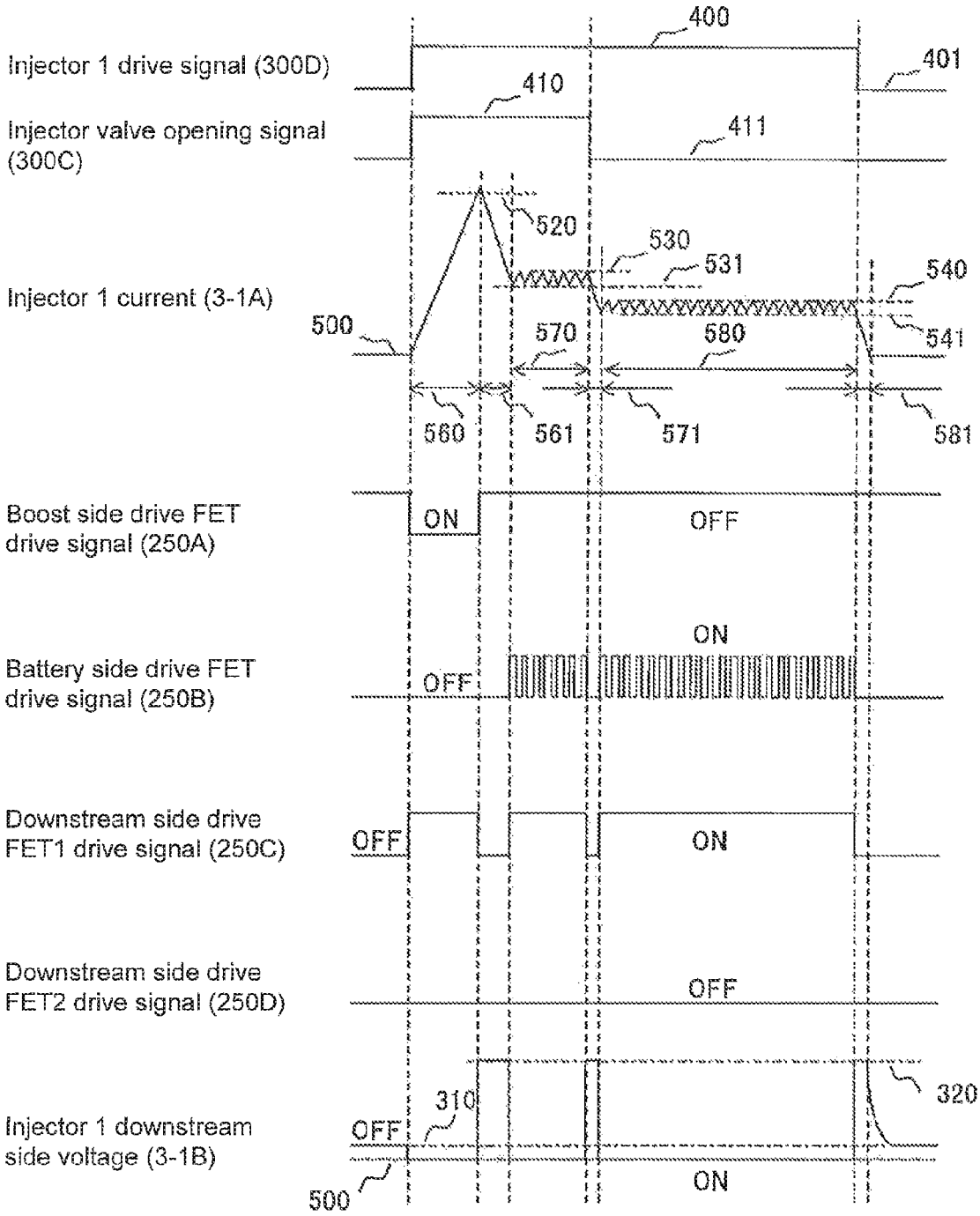
FIG. 1 is a diagram showing an example of typical operation waveforms in embodiments 1 to 5 of an internal combustion engine controller according to the present invention.
Figure 2:
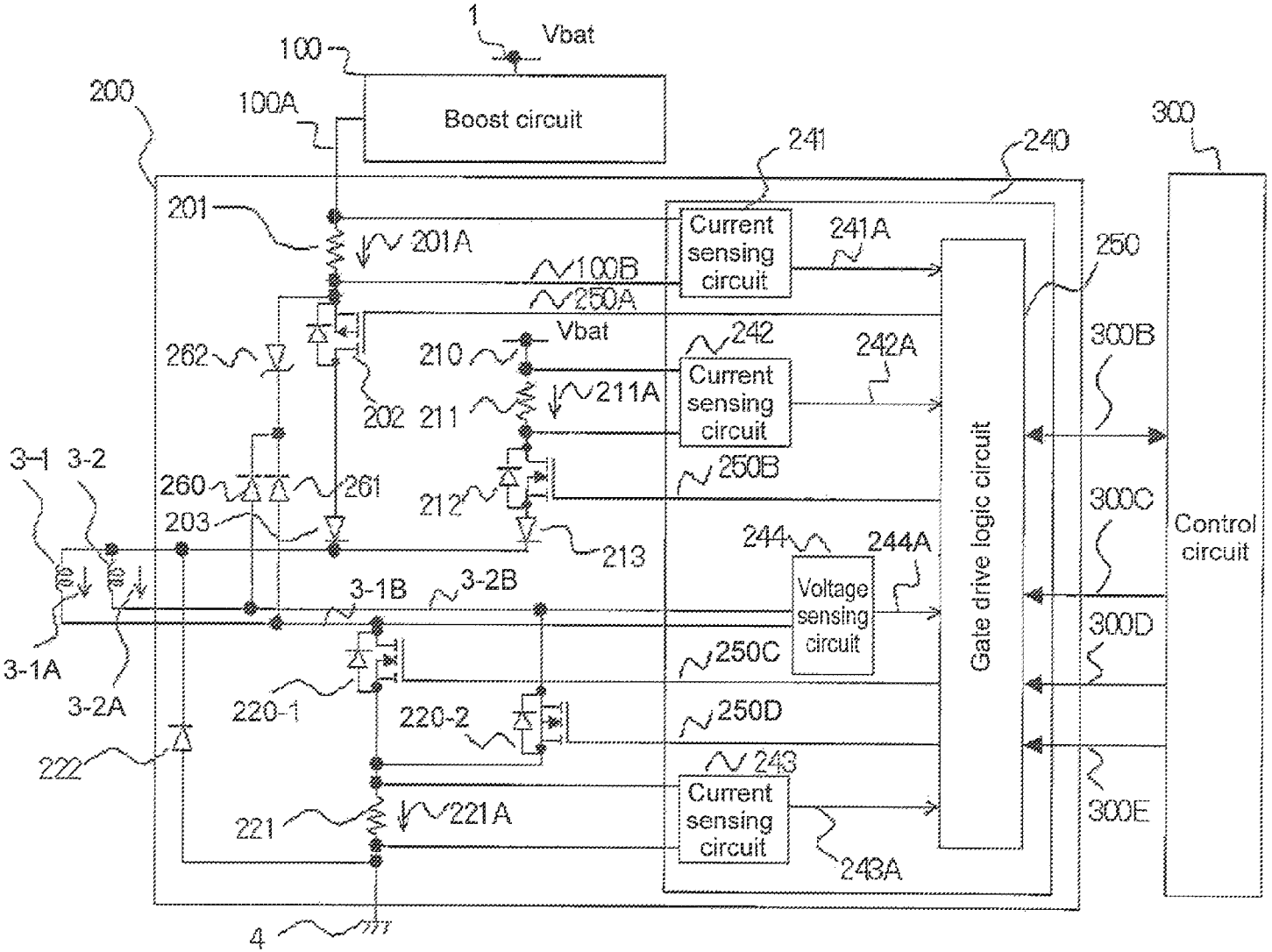
FIG. 2 is a diagram showing a circuit configuration of embodiment 1 of the internal combustion engine controller according to the present invention.

FIG. 2 shows a circuit configuration of embodiment 1 of an internal combustion engine controller according to the present invention. Embodiment 1 is an example of application of a plurality of injectors (3-1, 3-2) to a drive circuit (200) to be driven, and an example of a typical operation waveform of each part is shown in FIG. 1.

In a direct injector which uses a boost voltage (100A) obtained by boosting a battery voltage (1), the drive circuit (200) is generally shared by two injectors (3-1, 3-2) or more. In the actual machine, one internal combustion engine controller is applied to an engine with four to eight cylinders, and the drive circuit (200) can drive a plurality of injectors with one circuit, FIG. 2 shows the case of application of one drive circuit to two injectors.

A boost circuit (100) is further shared by a plurality of drive circuits (200), and one to four circuits are usually loaded on one engine. The number of drive circuits which share the boost circuit is determined by energy required for driving in a peak current energization time period (560) of an injector current (3-1A) in FIG. 2, the highest speed of the engine, the boost voltage recovery time period determined by the number of fuel injection times from the injector to one combustion in the same cylinder and the like, self-heating of the boost circuit (100) and the like.

The boost voltage (100A) which is boosted in the boost circuit (100) is connected to an upstream side of the injectors (3-1, 3-2) through a boost side current sensing resistor (201) which converts a boost side drive current (201A) into a voltage for sensing an overcurrent of an outflow current from the boost circuit (100), harness wire breakage of the injectors (3-1, 3-2) side or the like, a boost side drive FET (202) for driving in the peak current energization time period (560) of the injector current (3-1A) in FIG. 1, and a boost side protection diode (203) for preventing a reverse current at the time of failure of the boost circuit (100).

A battery side current sensing resistor (211), a battery side drive FET (212) and a battery side protection diode (213) are sequentially connected to the upstream side of the injectors (3-1, 3-2). The battery side current sensing resistor (211) is for converting a battery side drive current (211A) into a voltage to sense an overcurrent from a battery power supply (210), harness wire breakage at the injectors (3-1, 3-2) side or the like. The battery side drive FET (212) is for driving a holding 1 stop current (530) and a holding 2 stop current (540) of the injector current (3-1A) shown in FIG. 2. The battery side protection diode (213) is for preventing a backflow to the battery power supply (210) from the boost voltage (100A).

Downstream side drive FETs are respectively connected to a plurality of injectors (3-1, 3-2). By switching operation of a downstream side drive FET1 (220-1) or a downstream side drive FET2 (220-1), the injectors (3-1, 3-2) to be energized are determined, the injector currents (3-1A, 3-2A) which flow to the respective injectors are collected further upstream of the downstream side drive FETs, and flow to a power supply ground (4) through a downstream side current sensing resistor (221) which converts a current into a voltage.

Further, a drain terminal of the downstream side drive FET1 (220-1) or the downstream side drive FET2 (220-2) is connected to a voltage sensing circuit (244) for sensing a short to an abnormal voltage at the downstream side of the injectors (3-1, 3-2), wire breakage of the harness or the like. The voltage sensing circuit (244) has a feedback control function for fixing the downstream side of the injectors (3-1, 3-2) to a predetermined voltage (310) by an extremely weak pull-up current when the boost side drive FET (202), the battery side drive FET (212) and the downstream side drive FET1 (220-1) or the downstream side drive FET2 (220-2) are cut off.

Further, in order to cut off the boost side drive FET (202) and the battery side drive FET (212) at the upstream side at the same time while the injector currents (3-1A, 3-2A) are passed and to recirculate the regeneration current of the injector which is generated by energizing the downstream side drive FET1 (220-1) or the downstream side drive FET2 (220-2) at the injector (3-1 or 3-2) side which is selected, a recirculation diode (222) is connected to the upstream side of the above described injectors from the power supply ground (4).

Further, in order to cause the boost circuit (100) to regenerate the electric energy of the injectors (3-1, 3-2) which is selected when all the boost side drive FET (202) and the battery side drive FET (212) at the upstream side and the downstream side drive FET1 (220-1) and the downstream side drive FET2 (220-2) are cut off while the injector currents (3-1A, 3-2A) are passed, current regenerating diodes (260, 261) are connected to the boost voltage side of the boost circuit from the downstream side of the injector.

A boost side current sensing circuit (241) in an injector control circuit (240) senses a boost side drive current (201A) by the boost side current sensing resistor (201), and outputs a boost high side current sense signal (241A) to a gate drive logic circuit (250). Similarly, a battery side current sensing circuit (242) senses a battery side drive current (211A) by the battery side current sensing resistor (211), and outputs a battery high side current sense signal (242A) to the gate drive logic circuit (250). Similarly, a downstream side current sensing circuit (243) senses a downstream side drive current (221A) by the downstream side current sensing resistor (221), and outputs a low side current sense signal (243A) to the gate drive logic circuit (250).

Further, a control circuit (300) outputs an injector valve opening signal (300C), an injector 1 drive signal (300D) and an injector 2 drive signal (300E) to the gate drive logic circuit (250) based on the engine speed and the input conditions from various sensors.

The gate drive logic circuit (250) provided in the injector control circuit (240) outputs a boost side drive ITT control signal (250A), a battery side drive FET control signal (250B), a downstream side drive FET1 control signal (250C) and a downstream side drive FET2 control signal (250D) based on the above described signals, and by these signals, switching of the drive elements of the boost side drive ITT (202), the battery side drive FET (212), the downstream side drive FET1 (220-1) and the downstream side drive FET2 (220-2) is controlled.

Further, the control circuit (300) and the injector control circuit (240) exchange necessary information with each other from the control signals of the injector control circuit (240) itself by a communication signal (300B) between the drive circuit and the control circuit, such as a peak current stop current (520), the holding 1 stop current (530), a holding 1 start current (531), a holding 2 stop current (540), a holding 2 start current (541), a peak current holding time period, a holding 1 current time period (570), a holding 2 current time period (580), and diagnosis results of presence or absence of the peak current, presence or absence of implementation of peak current holding, switch of abrupt/gradual of a peak current drop, presence or absence of implementation of the holding 1 current, switch of abrupt/gradual of a holding 1 current drop, overcurrent sensing, wire breakage sensing, overheating protection, boost circuit failure and the like, and realize favorable injector drive.

In such a drive circuit (200), the current waveform of the typical direct injector is the injector 1 current (3-1A) shown in FIG. 1. In the peak current energization time period (560) at the initial time of energization, the injector current (3-1A) is increased to the peak current stop current (520) set in advance in a short time by using the boost voltage. The peak current is about 5 to 20 times as large as the injector current of the method which prepares a gaseous mixture of a fuel and air and injects the gaseous mixture into the cylinder, and is the main stream of the present gasoline engines.

After the above described peak current energization time period (560) ends, the energy supply source to the injector (3-1) shifts to the battery power supply (210) from the boost voltage (100A), the time goes through the holding 1 current time period in which control is performed with the holding 1 stop current (530) which is about ½ to ⅓ as compared with the peak current and further shifts to a holding 2 current time period in which control is performed with the holding 2 stop current (540) which is about ⅔ to ½ of the holding 1 stop current (530). The valve of the injector (3-1) is opened by the peak current, and the valve opening state of the injector (3-1) is kept by the holding current 1 and the holding current 2. During this while, a fuel is injected into the cylinder. The holding current 1 is set at a current higher than the holding current 2 so as to suppress vibration of the injector valve immediately after the valve opening.

At the time of end of the injection, in order to close the valve of the injector (3-1) quickly, the energization current drop time period (581) of the injector energizing current (3-1A) needs to be implemented in a short time, and the injector current (3-1A) needs to be cut off.

In the energization current drop time period (581) which is the time period for dropping the injector current (3-1A), the peak current drop time period (561) and the holding current 1 drop time period (571), the current is preferably dropped in a short time, and this is instructed by the communication signal (3009) between the drive circuit and the control circuit. The operation of the injector drive circuit (200) at this time is performed by cutting off all the boost side drive FET (202), the battery side drive FET (212) and the downstream side drive FET1 (220-1) as in the energization current drop time period (581).

Quick drop of the injector current (3-1A) reduces the difference in response time due to variation between the injectors (3-1, 3-2), by extension, the variation of the fuel injection amount among the cylinders, and makes fuel injection amount control of the injector (3-1) more accurate. At the same time, the valve opening response speed becomes high, and therefore, it is effective for improvement of fuel efficiency by reducing useless injection of the fuel.

However, high energy is accumulated in the injector (3-1) since the injector current (3-1A) flows therein, and in order to cut off the current, it is necessary to eliminate the energy from the injector (3-1). More specifically, the drop time of the injector current (3-1A) is determined by the energy elimination amount per hour from the injector (3-1). Therefore, if the clamping voltage (320) at the time of cutoff of the injector current (3-1A) (see FIG. 1) is high, the amount of the energy which shifts to the clamp circuit side out of the energy accumulated in the injector per hour, becomes large, and as a result, drop of the injector current (3-1A) becomes fast.

Thus, in the current path for allowing the boost circuit (100) to regenerate the electric energy of the injector (3-1) from the downstream side of the injector (3-1) through the current regenerating diode (261), the current regenerating diode (261) is provided with a Zener diode (262) in series as a voltage regulating section, the clamping voltage is set to be higher, and the injector current (3-1A) is quickly dropped.

Figure 7:
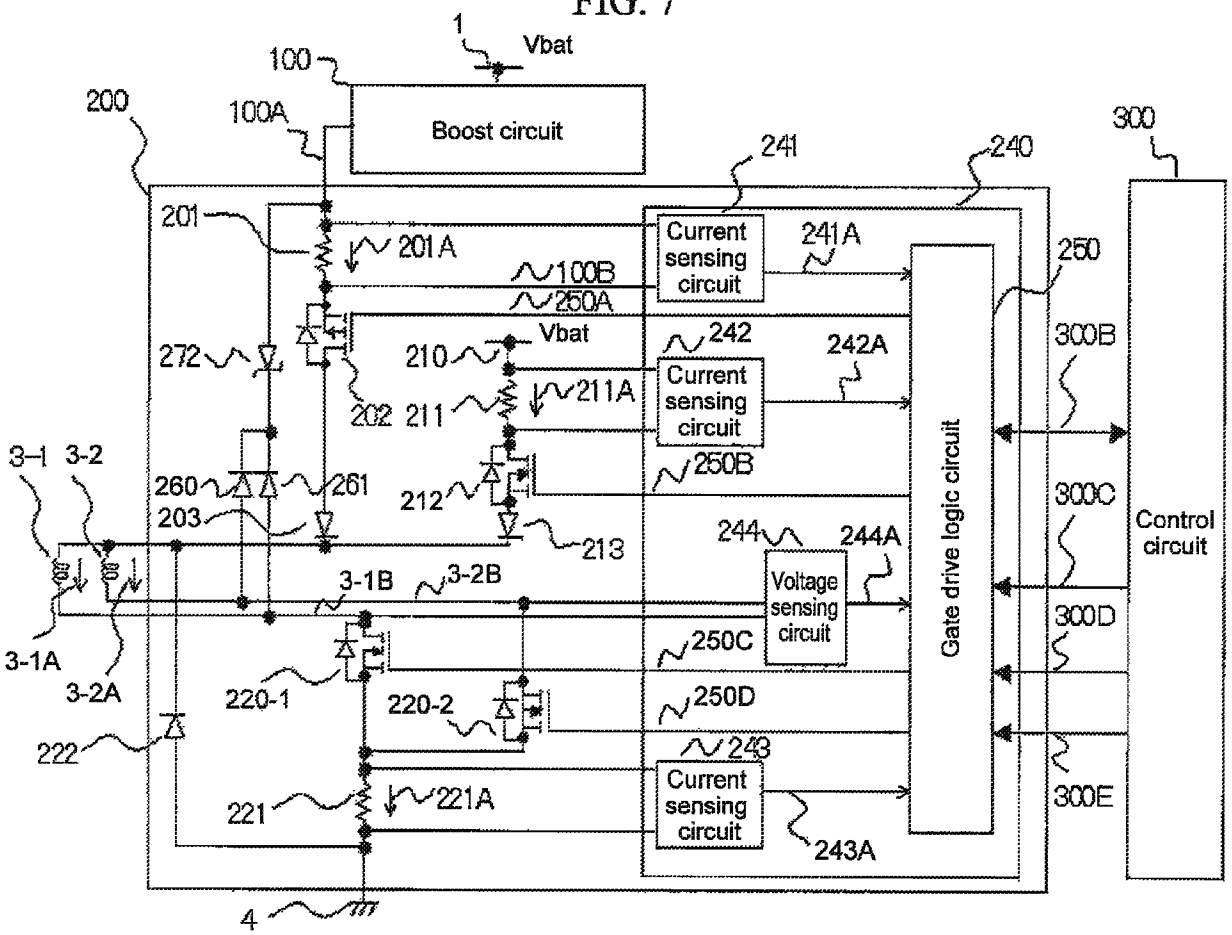
FIG. 7 is a diagram showing a circuit configuration of embodiment 6 of the internal combustion engine controller according to the present invention.

Here, with regard to the connecting destination at the boost circuit (100) side, of the voltage regulating section, the voltage which is generated in the boost side current sensing resistor (201) and the injector current (3-1A) to be regenerated is so small that can be ignored as compared with the clamping voltage (320), whether the voltage regulating section is connected to the downstream side of the boost side current sensing resistor (201) as shown in FIG. 2, or the voltage regulating section is connected to the upstream side of the boost side current sensing resistor (201) as shown in embodiment 6 of FIG. 7 which will be described later, and therefore, quick drop of the injector current can be obtained. However, when the voltage regulating section is connected to downstream side of the boost side current sensing resistor (201), the injector current (3-1A) which is regenerated by the boost circuit (100) can be sensed.

For example, in embodiment 1, when the Zener diode (262) is added in series with the current regenerating diode (261) as the voltage regulating section in such a manner that an anode of the Zener diode (262) is at the boost voltage side (100B) and a cathode is at the downstream side (3-1B) of the injector, the clamping voltage (320) of the injector (3-1) has the total value of the boost voltage (100B), a forward voltage of the regenerating diode (261) and a Zener voltage of the Zener diode (262). Accordingly, as introduced by JP Patent Application Publication No. 2003-106200 A, by the Zener diode effect of the downstream side drive FET1 (220-1), the voltage between the terminals of the interposed Zener diode (262) is small by the boost voltage (100B) and the forward voltage of the current regenerating diode (261) as compared with the ease in which the same clamping voltage is generated between the drain and source of the downstream side drive FET (220-1), and therefore, heat generation of the Zener diode (262) is suppressed correspondingly. Further, the desired clamping voltage (320) can be realized by properly selecting the Zener diode (262).

Embodiment 2

Figure 3:
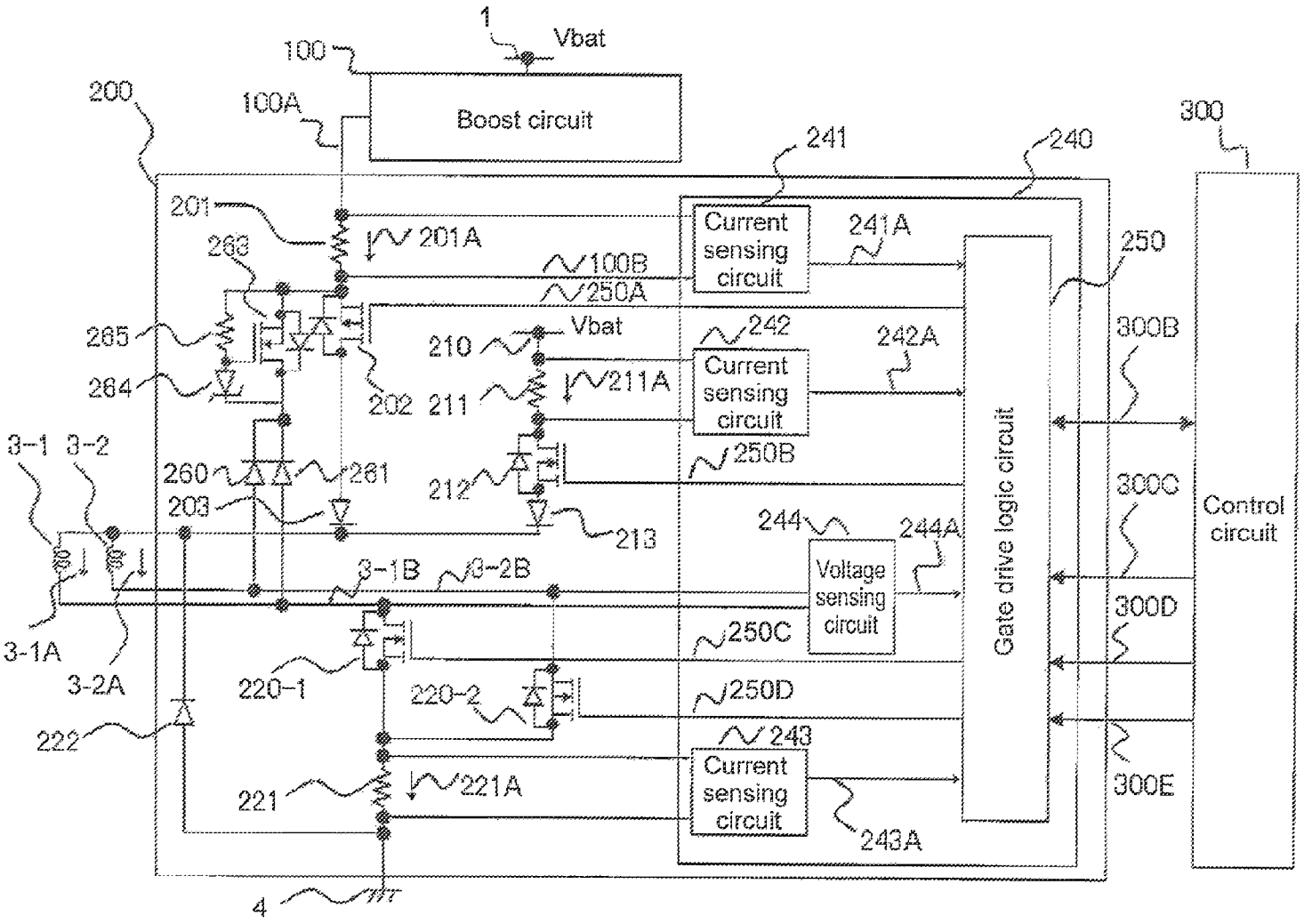
FIG. 3 is a diagram showing a circuit configuration of embodiment 2 of the internal combustion engine controller according to the present invention.

FIG. 3 shows a circuit configuration of embodiment 2 of the internal combustion engine controller according to the present invention, and the typical operation waveform of each of the parts thereof is shown in FIG. 1.

In the embodiment 2, a voltage regulating section is configured by a MOSFET (263), Zener diode (264) and a resistor (265) in the circuit of embodiment 1.

The MOSFET (2.63) is interposed in series with the current regenerating diode (261) in such a manner that a drain thereof faces the downstream side of the injector (3-1) and a source thereof faces the boost voltage side, the Zener diode (264) is connected in such a manner that a cathode of the Zener diode (264) faces the drain of the MOSFET (263) and an anode faces a gate, and the resistor (265) is connected to between the gate and the source of the MOSFET (263).

Since in the circuit configuration of embodiment 2, the voltage between the drain and the source of the MOSFET (263) is determined by the Zener diode (264), the clamping voltage (320) of the injector (3-1) has the total value of the boost voltage (100A), the forward voltage of the regenerating diode (261) and a Zener voltage of the Zener diode (264), and can be set to a voltage higher than the boost voltage (100A).

The MOSFET (263) of embodiment 2 is properly selected in accordance with the heat generation amount by the drive conditions of the injectors (3-1, 3-2) similarly to the Zener diode (262) of embodiment 1. When the Zener voltages of the Zener diode (262) of embodiment 1 and the Zener diode (264) of embodiment 2 are the same, the heat generation amounts of the Zener diode (262) of embodiment 1 and the MOSFET (263) of embodiment 2 are equivalent, but since as MOSFETs, many packages excellent in heat release performance are marketed in general, an MOSFET has the advantage that the components excellent in heat release performance are easily selectable as compared with a Zener diode.

Embodiment 3

Figure 4:
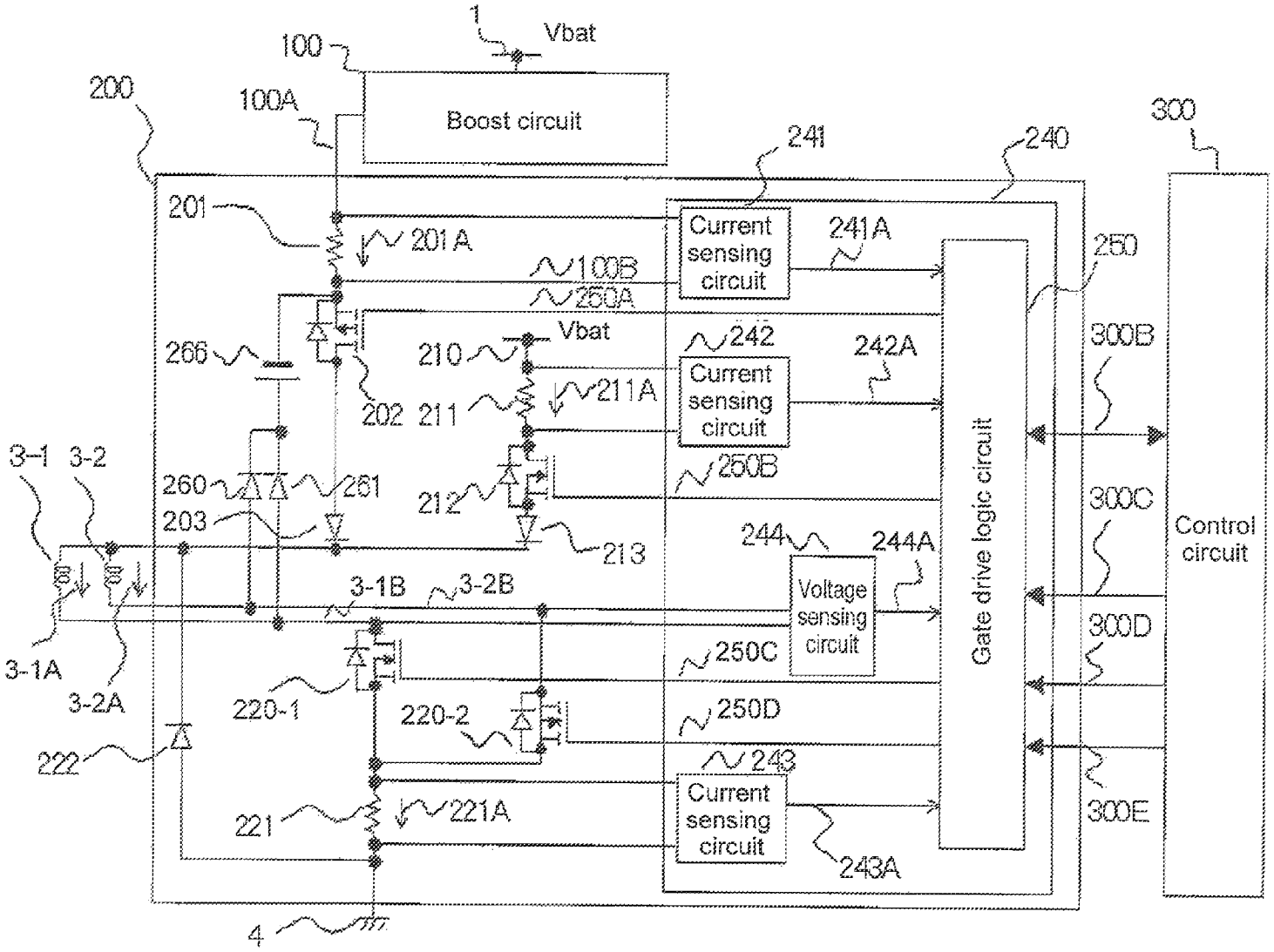
FIG. 4 is a diagram showing a circuit configuration of embodiment 3 of the internal combustion engine controller according to the present invention.

FIG. 4 shows a circuit configuration of embodiment 3 of the internal combustion engine controller according to the present invention, and the typical operation waveform of each of the parts thereof is shown in FIG. 1.

In embodiment 3, a voltage regulating section is configured by a constant voltage source (266) in the circuit of embodiment 1. If the boost voltage (100A) is set as a reference, and the voltage which is higher than the boost voltage (100A) is generated and used as the voltage regulating section, the clamping voltage (320) of the injector (3-1) has the total value of the boost voltage (100A), the voltage of the constant voltage source (266) and the forward voltage of the regenerating diode (261), and can be set at a voltage higher than the boost voltage (100A).

Embodiment 4

Figure 5:
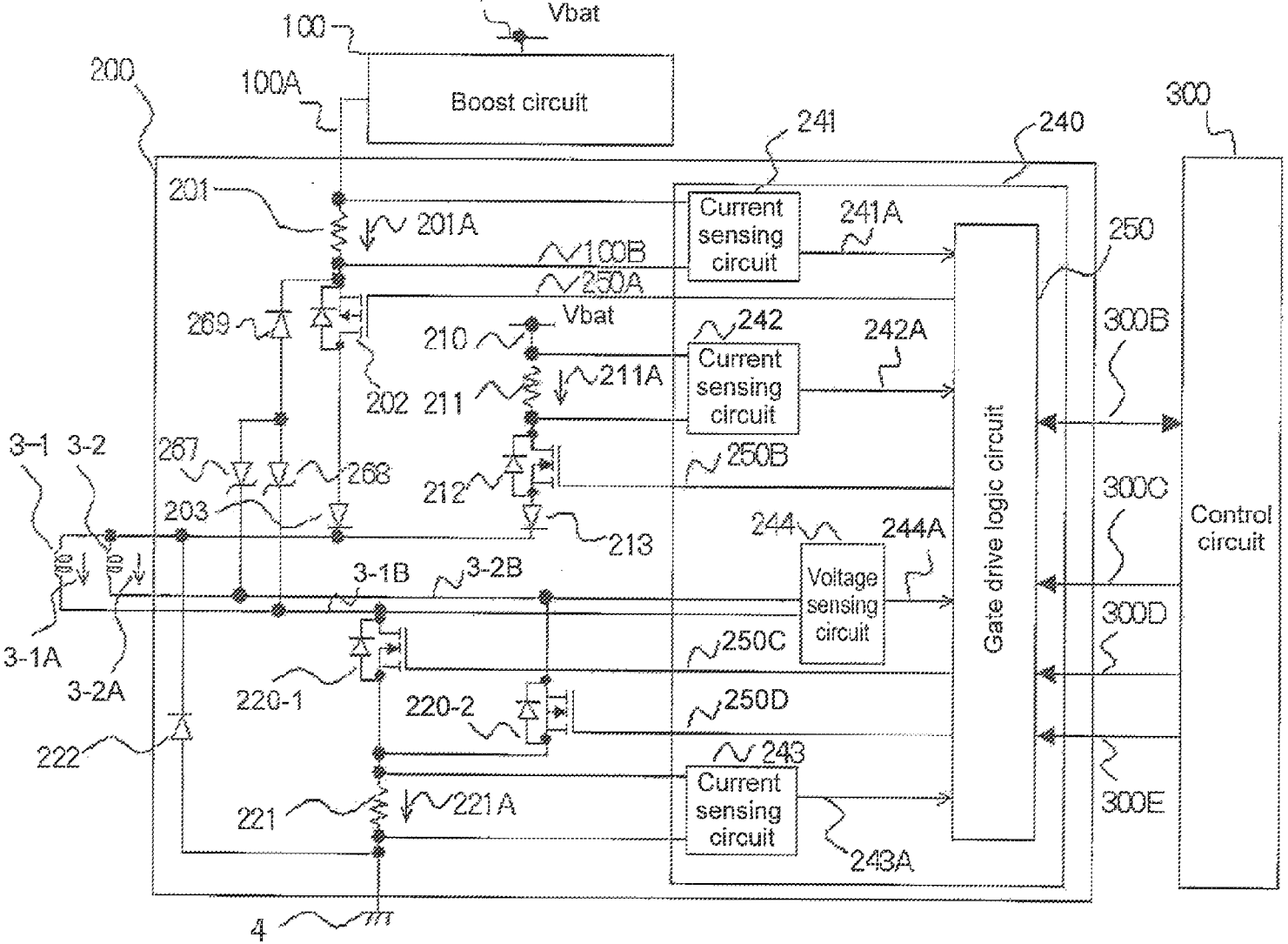
FIG. 5 is a diagram showing a circuit configuration of embodiment 4 of the internal combustion engine controller according to the present invention.

FIG. 5 shows a circuit configuration of embodiment 4 of the internal combustion engine controller according to the present invention, and the typical operation waveform of each of the parts thereof is shown in FIG. 1.

Embodiment 4 is configured by changing the positions of the Zener diode (262) of the voltage regulating section and the current regenerating diodes (260, 261) in the circuit configuration of embodiment 1 to each other.

In the circuit configuration of embodiment 4, the clamping voltage (320) of the injector (3-1) has the total value of the boost voltage (100A), the Zener voltage of the Zener diode (268), and the forward voltage of the regenerating diode (269), and can be set at a voltage higher than the boost voltage (100A).

If the regenerating diodes (260, 261, 269) and the voltage regulating section are connected in series so that the current regenerating diodes (260, 261, 269) seen in embodiments 1 to 4 prevents the flow of a current to a downstream side of an injector from the boost voltage (100A), which is the original object thereof, and performs energization of the boost circuit (100) from the downstream side of the injector at the time of cutoff of the injector current, and the voltage regulating section can increase the clamping voltage (320) at the time of cutoff of the injector current, which is an original object thereof, the clamping voltage (320) can be obtained, which is the effect of the present invention, and the present invention is not limited to the positional relationship in embodiment 1 in which the voltage regulating section is provided at the boost circuit (100) side, and the current regenerating diodes (260, 261) are provided at the downstream side of the injector.

Further, the voltage regulating section can be replaced with the Zener diode (262) of embodiment 1, the MOSFET (263) of embodiment 2, and the constant voltage source (266) of embodiment 4, and is not especially limited to the Zener diode (262).

Embodiment 5

Figure 6:
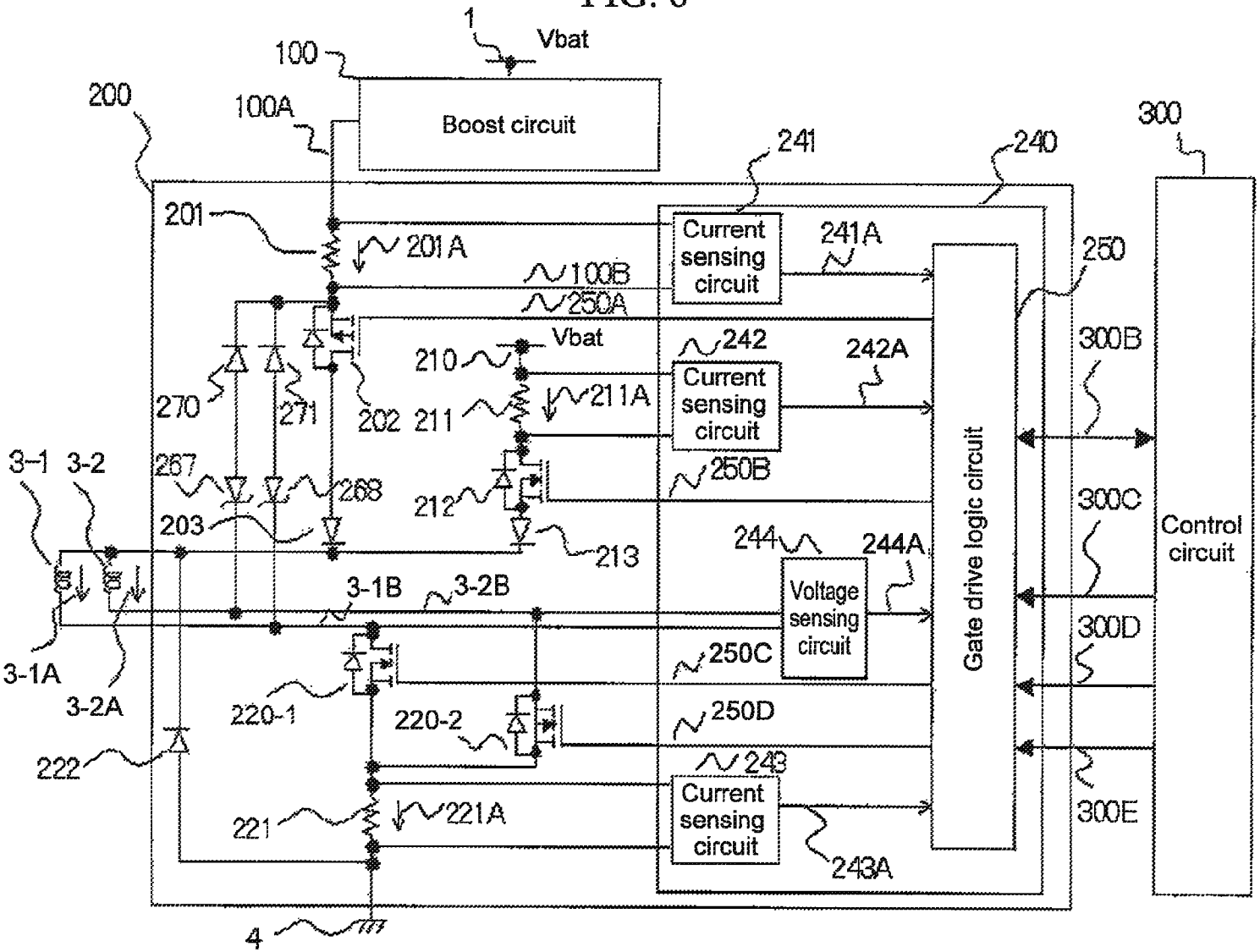
FIG. 6 is a diagram showing a circuit configuration of embodiment 5 of the internal combustion engine controller according to the present invention.

FIG. 6 shows a circuit configuration of embodiment 5 of the internal combustion engine controller according to the present invention, and the typical operation waveform of each of the parts thereof is shown in FIG. 1.

In embodiment 5, a Zener diode (267, 268) of the voltage regulating section and a current regenerating diode (270, 271) are provided for each injector (3-1, 3-2) in the circuit configuration of embodiment 1. As compared with the circuit configuration of embodiment 1, the clamping voltage (320) is the same, but the circuit configuration of embodiment 5 has the feature in which the heat generation amount per hour of the Zener diodes (267, 268) differs.

An internal combustion engine system usually rotates an output shaft thereof at as speed of several hundreds to several thousands r. p. m. in accordance with the load amount thereof, and the injector is driven in synchronism with the engine speed. Therefore, considering a plurality of times of generation of clamping voltage (320) in a certain fixed time in which injection of the injector is performed a plurality of times, there is provided the advantage that the heat generation amount of the Zener diodes (267, 268) which is the voltage regulating section in embodiment 5 can be suppressed to ½ as compared with the heat generation amount of the Zener diode (262) in embodiment 1.

Embodiment 6

FIG. 7 shows a circuit configuration of embodiment 6 of the internal combustion engine controller according to the present invention, and the typical operation waveform of each of the parts thereof is shown in FIG. 1.

In embodiment 6, the connecting destination of the Zener diode of the voltage regulating section is connected to the upstream side of the boost side current sensing resistor (201), that is, to the boost voltage (100A), in the circuit configuration of embodiment 1.

When a Zener diode (272) as the voltage regulating section is added in series with the current regenerating diode (261) in such a manner that an anode of the Zener diode (272) faces the boost voltage side (100A) and a cathode faces the downstream side (3-1B) of the injector in embodiment 6, the clamping voltage (320) of the injector (3-1) has the total value of the boost voltage (100A), the forward voltage of the regenerating diode (261) and the Zener voltage of the Zener diode (272).

Here, as for the connecting destination at the boost circuit (100) side, of the voltage regulating section (272), even if the voltage regulating section (272) is connected to an upstream side of the boost side current sensing resistor (201) as shown in FIG. 7, the voltage which is generated at the boost side current sensing resistor (201) and the injector current (3-1A) to be regenerated can be so small that the voltage can be ignored as compared with the clamping voltage (320), and quick drop of the injector current, which is the effect of the present invention, is obtained.

Embodiments 1 to 6 are described respectively above, but the present invention is not limited to these embodiments, and various changes can be made within the range based on the description of claims.

The present invention can be widely used in various industrial fields such as construction machinery and industrial machinery including automobiles, motorcycles, farm machines, machine tools and marine engines which use controllers of internal combustion engines which drive loads by using high voltages obtained by boosting battery voltages with gasoline, light oil and the like as fuels.

DESCRIPTION OF SYMBOLS

1 BATTERY POWER SUPPLY, 3-1 INJECTOR 1, 3-1A INJECTOR 1 CURRENT, 3-2 INJECTOR 2, 3-2A INJECTOR 2 CURRENT, 4 POWER SUPPLY GROUND, 100 BOOST CIRCUIT, 100A BOOST VOLTAGE, 100B BOOST VOLTAGE (DOWNSTREAM OF BOOST SIDE CURRENT SENSING RESISTOR), 200 DRIVE CIRCUIT, 201 BOOST SIDE CURRENT SENSING RESISTOR, 201A BOOST SIDE DRIVE CURRENT, 202 BOOST SIDE DRIVE PET, 203 BOOST SIDE PROTECTION DIODE, 210 BATTERY POWER SUPPLY, 211 BATTERY SIDE CURRENT SENSING RESISTOR, 211A BATTERY SIDE DRIVE CURRENT, 212 BATTERY SIDE DRIVE FET, 213 BATTERY SIDE PROTECTION DIODE, 220-1 DOWNSTREAM SIDE DRIVE FET1, 220-2 DOWNSTREAM SIDE DRIVE FET2, 221 DOWNSTREAM SIDE CURRENT SENSING RESISTOR, 221A DOWNSTREAM SIDE DRIVE CURRENT, 222 RECIRCULATION DIODE, 240 INJECTOR CONTROL CIRCUIT, 241 BOOST SIDE CURRENT SENSING CIRCUIT, 241A BOOST HIGH SIDE CURRENT SENSE SIGNAL, 242 BATTERY SIDE CURRENT SENSING CIRCUIT, 242A BATTERY HIGH SIDE CURRENT SENSE SIGNAL, 243 DOWNSTREAM SIDE CURRENT SENSING CIRCUIT, 243A LOW SIDE CURRENT SENSE SIGNAL, 244 LOW SIDE VOLTAGE SENSING CIRCUIT, 244A LOW SIDE VOLTAGE SENSE SIGNAL, 250 GATE DRIVE LOGIC CIRCUIT, 250A BOOST SIDE DRIVE FET CONTROL SIGNAL, 250B BATTERY SIDE DRIVE FET CONTROL SIGNAL, 250C DOWNSTREAM SIDE DRIVE FET1 CONTROL SIGNAL, 250D DOWNSTREAM SIDE DRIVE FET2 CONTROL SIGNAL, 300 CONTROL CIRCUIT, 300B COMMUNICATION SIGNAL BETWEEN DRIVE CIRCUIT AND CONTROL CIRCUIT, 300C INJECTOR VALVE OPENING SIGNAL, 300D INJECTOR 1 DRIVE SIGNAL, 300E INJECTOR 2 DRIVE SIGNAL, 400 INJECTOR 1 ENERGIZATION SIGNAL, 401 INJECTOR 1 NON-ENERGIZATION SIGNAL, 410 INJECTOR VALVE OPENING ENERGIZATION SIGNAL, 411 INJECTOR VALVE OPENING NON ENERGIZATION SIGNAL, 500 POWER SUPPLY GROUND VOLTAGE, 520 PEAK CURRENT STOP CURRENT, 530 HOLDING 1 STOP CURRENT, 531 HOLDING 1 START CURRENT, 540 HOLDING 2 STOP CURRENT, 541 HOLDING 2 START CURRENT, 560 PEAK CURRENT ENERGIZATION TIME PERIOD, 561 PEAK CURRENT DROP TIME PERIOD, 570 HOLDING 1 CURRENT TIME PERIOD, 571 HOLDING 1 CURRENT DROP TIME PERIOD, 580 HOLDING 2 CURRENT TIME PERIOD, 581 ENERGIZATION CURRENT DROP TIME PERIOD

What is claimed is:

1. A controller of an internal combustion engine comprising a drive circuit which drives an injector current for controlling an injector which injects a fuel, and a boost circuit which boosts a battery voltage, comprising:

a peak current path for driving a peak current by guiding a boost voltage of the boost circuit to an upstream side of the injector via a boost side switching element and a boost side protection diode;

a holding current path for driving a holding current by guiding the battery voltage to the upstream side of the injector via a battery side switching element and a battery side protection diode;

a ground current path which is connected to a power supply ground from a downstream side of the injector via a downstream side switching element; and a regenerating circuit which allows the boost circuit to regenerate electric energy of the injector from the downstream side of the injector via a current regenerating diode, wherein the regenerating path is provided with a voltage regulating section in series with the current regenerating diode, and the drive circuit controls drive of the switching element.

2. The controller of an internal combustion engine according to claim 1, wherein a recirculation path for returning the regeneration current of the injector to the upstream side of the injector via a recirculation diode from a downstream side of the downstream side switching element.

3. The controller of an internal combustion engine according to claim 1, wherein a plurality of the current regenerating diodes are connected in parallel with each other to one of the voltage regulating sections.

4. The controller of an internal combustion engine according to claim 1, wherein a set of the voltage regulating section connected in series with one of the current regenerating diodes configures one cylinder.

5. The controller of an internal combustion engine according to claim 1, wherein the voltage regulating section is a Zener diode.

6. The controller of an internal combustion engine according to claim 5, wherein the peak current path comprises a boost side current sensing resistor at an upstream side of the boost side switching element, and an anode of the Zener diode is connected to between the boost side current sensing resistor and the boost side switching element.

7. The controller of an internal combustion engine according to claim 1, wherein the voltage regulating section is configured by a MOSFET, a Zener diode and a resistor.

8. The controller of an internal combustion engine according to claim 7, wherein the MOSFET is interposed in series with the current regenerating diode in such a manner that a drain thereof faces the downstream side of the injector and a source thereof faces the boost voltage side, a cathode of the Zener diode is connected to the drain of the MOSFET, an anode of the Zener diode is connected to a gate of the MOSFET, and the resistor is connected to between the gate and the source of the MOSFET.

9. The controller of an internal combustion engine according to claim 1, wherein a constant voltage source is used as the voltage regulating section, and is connected to have a reference voltage of the voltage source at the boost circuit side and a positive voltage at the downstream side of the injector.

10. The controller of an internal combustion engine according to claim 1, wherein the controller is provided with a boost side current sensing resistor in the peak current path, a battery side current sensing resistor in the holding current path, and a downstream side current sensing resistor in the ground current path, and the drive circuit controls drive of the switching element based on current values sensed by the sensing resistors.

* * * * *